United States Patent [19]

Yoshida et al.

[11] 4,238,915

[45] Dec. 16, 1980

[54] TILE SETTING ASSEMBLY, TILE WALL AND METHOD FOR BUILDING A TILE WALL

[76] Inventors: Yoshio Yoshida, No. 1 Ohodori 9-chome; Takeshi Tanizaki, No. 1 Kitashichijyo Nishi 16-chome, both of Chuoh-ku, Sapporo, Hokkaido, Japan

[21] Appl. No.: 938,307

[22] Filed: Aug. 29, 1978

[30] Foreign Application Priority Data

Dec. 15, 1977 [JP] Japan ..... 52/149959

[51] Int. Cl.[2] ..... E04B 1/38

[52] U.S. Cl. ..... 52/510; 52/512; 52/386; 52/747

[58] Field of Search ..... 52/386, 512, 513, 506, 52/510, 385, 387, 390, 391, 384, 747

[56] References Cited

U.S. PATENT DOCUMENTS

| | | | |
|---|---|---|---|
| 2,132,499 | 10/1938 | Tothill | 52/391 X |
| 2,882,713 | 4/1959 | Diehl | 52/387 |
| 3,005,293 | 10/1961 | Hunter | 52/510 X |

*Primary Examiner*—James A. Leppink
*Assistant Examiner*—Carl D. Friedman
*Attorney, Agent, or Firm*—Wenderoth, Lind & Ponack

[57] ABSTRACT

A tile setting assembly is made up of a panel which spans at least two pillars of a building and has a plurality of spaced parallel projections on one surface, and a plurality of holding members which are secured to the panel while abutting against the projections. Each holding member has opposed and spaced engaging portions for holding tiles. The holding members are made up of first holding members which are secured to the panel projections for holding a first set of elongated straight tiles which are secured to the major part of the panel with the exception of the opposite ends of the panel, and second holding members which are secured to the panel at the opposite ends of the panel for holding a second set of L-shaped tiles at the corners of a tiled wall which is to be built. A tiled wall is made up of the above-described components of the tile setting assembly with mortar filled in at the joint spaces between the adjacent tiles. The components of the above-described tile setting assembly being used in a new method of building tiled walls.

7 Claims, 10 Drawing Figures

TILE SETTING ASSEMBLY, TILE WALL AND METHOD FOR BUILDING A TILE WALL

BACKGROUND OF THE INVENTION

This invention relates to a tile setting assembly, a tiled wall and a method for building the tiled wall.

There have been proposed and practically employed a variety of methods for building tiled walls at predetermined or desired portions of a wooden house. In one of the prior art tiled wall building methods, a carpenter nails enlongated boards having a small width to the spaced pillars of the house, the boards being nailed in horizontal and vertical arrays. A plasterer then first applies sheets of under-all paper and then attaches fine-mesh screens to the boards and places mortar on the screens thereby providing an underlying wall structure and thereafter, a tile setter sets the tiles on the underlying wall structure while indexing the setting positions of the tiles by using a line of indexing string.

However, the prior art tile setting method referred to hereinabove requires different occupation types of workers to perform the various steps in the tile setting operation. More specifically, the board nailing requires a carpenter, the underlying wall structure forming operation requires a plasterer, and the tile setting operation requires a tile setter. In addition, in practice, it is very difficult, laborious and time consuming to efficiently coordinate the various occupational workers to perform the various steps, thereby wasting time and resulting in a longer building contract period and an increase in construction cost.

Even more importantly, in order to set the tiles by using mortar in the underlying wall structure while at the same time precisely indexing the positions of tiles to be set, the tile setter should be an experienced tile setter and thus, prior art tile setting methods have the disadvantage that an unexperienced worker will encounter substantial difficulty in setting tiles and thus cannot perform the operation correctly.

SUMMARY OF THE INVENTION

Therefore, the present invention provides a tile setting assembly, a tiled wall incorporating the tile setting assembly, and a method of building the tiled wall which can effectively eliminate the disadvantages which are inherent in prior art tiled wall building methods, and which enables unskilled workers to build a tiled wall in a sample and efficient manner.

The above and other objects, features and advantages of the present invention will be more readily apparent to those skilled in the art from a reading of the following detailed description in conjunction with the accompanying drawings which show a preferred embodiment of the invention for illustration purposes only, but does not limit the scope of the invention in any way.

BRIEF DESCRIPTION OF THE DRAWINGS

The accompanying drawings show a preferred embodiment of the tile setting assembly, tiled wall and method for building a tiled wall of the present invention in which.

PREFERRED EMBODIMENT OF THE INVENTION

The present invention will now be described with reference to the accompanying drawings which show a preferred embodiment of the present invention.

Figure 1:
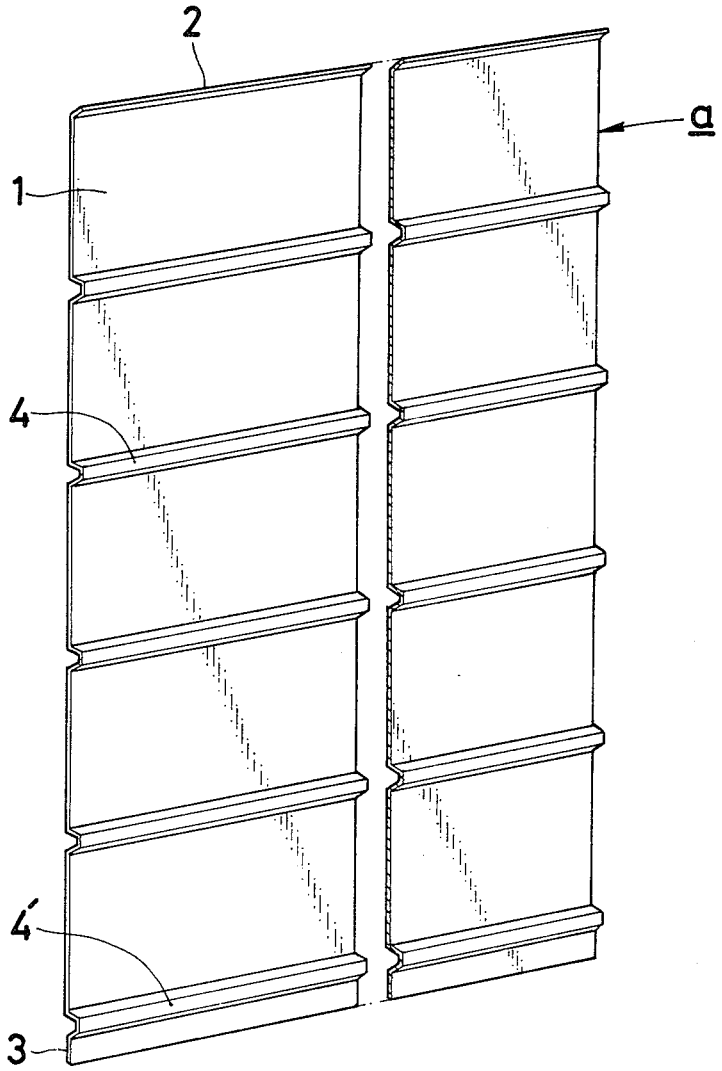
FIG. 1 is a fragmentary perspective view of a building panel on which tiles are to be set by the method of the present invention.

Reference character a denotes a panel on which tiles are to be set. The panel is made up of a rectangular aluminum base plate 1 having a greater dimension in the horizontal direction sufficient to span at least two pillars of a building and a smaller dimension in the vertical direction (as seen in FIG. 1). The upper side edge of the base plate 1 (as seen in FIG. 1) is bent outwardly or towards the viewer at an angle greater than 90° to form a first connection 2 and the lower side edge 3 of the panel is offset outwardly or towards the viewer in the same direction as the first connection 2 by a distance which substantially corresponds to the thickness of the base plate for forming a second connection 3.

The intermediate portion of the base plate 1 between the first and second connections 2 and 3 has a plurality of equally spaced and parallel horizontal projections 4 which have a trapezoidal cross-section and are formed by bending the base plate intermediate portion at equally spaced locations and at different heights thereon. As will be described in detail later, the projections serve as the reference markings for indexing the setting positions for the tiles and also as the reinforcing ribs of the base plate 1.

The lowermost projection 4' (as seen in FIG. 1) is located just above and adjacent to the second connection 3.

Figure 2:
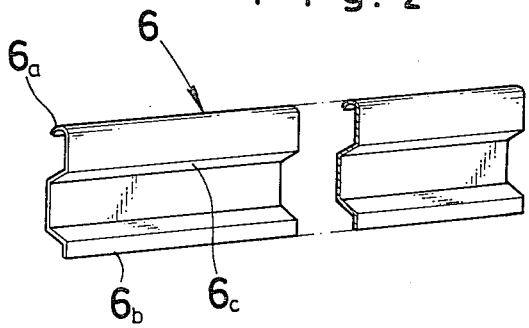
FIG. 2 is a perspective view of a first tile holding member with a portion thereof cut away.
Figure 6:
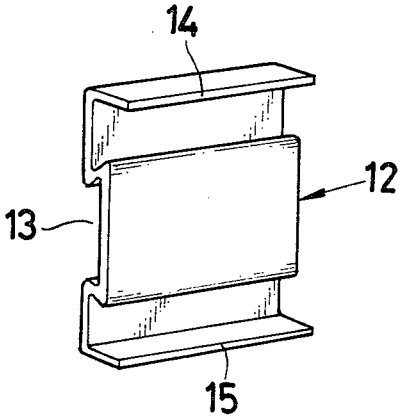
FIG. 6 is a perspective view of the holding member for said second tile.

Reference numeral 6 (FIG. 2) denotes a first holding member which is adapted to be fitted on each of the projections 4 along the length of the projections 4 with the holding member being an elongated aluminum strip having a first engaging portion *6a* which extends along the upper side edge (as seen in FIG. 6) and has a substantially U-shaped cross-section and a second engaging portion *6b* which extends along the other or lower side edge and has a substantially L-shaped cross-section. The intermediate portion between the first and second engaging portions *6a* and *6b* is a flat portion *6c* located between and connecting the first and second engaging portions *6a* and *6b*. The first and second engaging portions *6a* and *6b* project outwardly and the flat portion *6c* projects inwardly (as seen when the holding member 6 is held in position).

Figure 7:
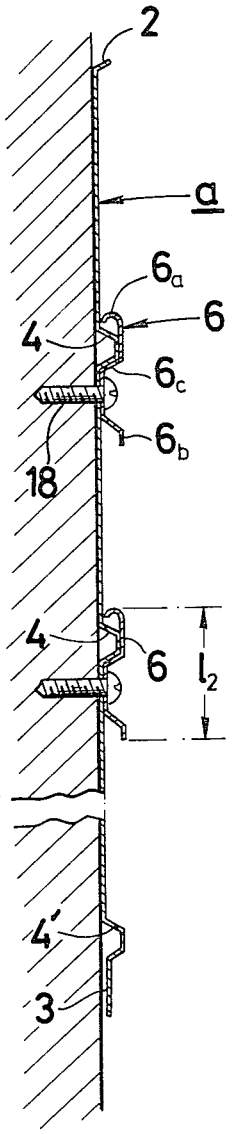
FIG. 7 is a fragmentary vertically sectional view of a pillar of a wooden house having the panel of FIG. 1 secured thereto.

The holding member 6 is constructed so that when the projection *6c* abuts against the portion of the panel 2 which is positioned immediately below the lower sloped leg of the associated projection 4 of the panel 2. The lower slope leg of the first engaging portion 6a abuts against the lower sloped leg of the same projection 4 (as seen in FIG. 7). A lower part of the first engaging portion 6a abuts against the intermediate portion of the associated projection 4 with the remaining part of the intermediate portion and the upper sloped leg 6a being spaced from the upper sloped leg of the associated projection 4, and the second engaging part 6c being spaced from the panel 2 by predetermined distances, respectively.

Figure 3:
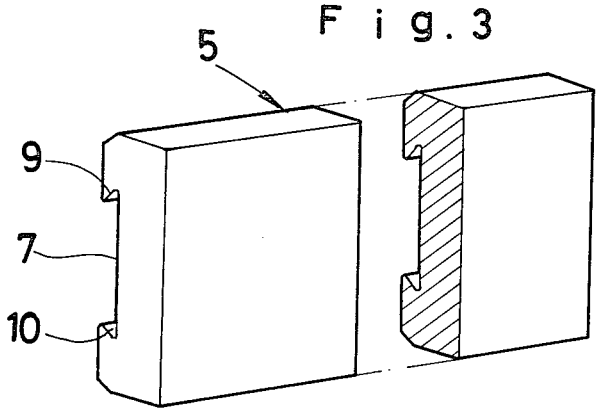
FIG. 3 is a perspective view of a first tile.
Figure 4:
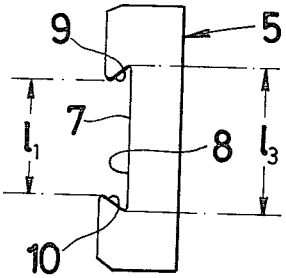
FIG. 4 is a side elevational view on an enlarged scale of the tile as shown in FIG. 3.
Figure 10:
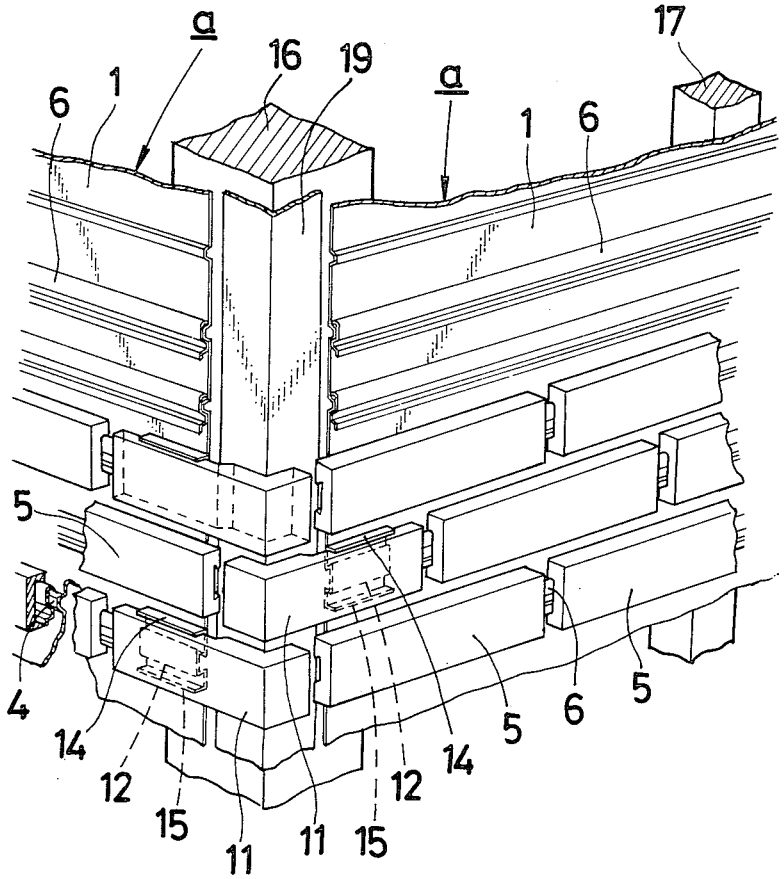
FIG. 10 is a fragmentary perspective view showing the manner in which said panels, first and second holding members and first and second tiles are arranged to form a tiled wall.

Reference numeral 5 denotes a first tile for use in the portion of the panel 2 which extends between adjacent pillars 16 and 17 (FIG. 10). The tile has a rectangular shape which has a substantially U-shaped cross section. The tile 5 is provided with a dovetailed groove 7 located substantially in the center thereof and extending along the length of the tile on the inner surface when the tile is held in position. The width of the open side $l_1$ of the dovetailed groove 7 is slightly smaller than the width $l_2$ of the holding member 6 (FIG. 7), and the width $l_3$ of the bottom of the groove 7 is slightly greater than the width $l_2$ of the holding member 6. The inner surfaces of the opposing side walls 9 and 10 of the dovetailed groove 7 form an acute angle with respect to the inner surface of the tile 5 (FIGS. 3 and 4).

Figure 5:
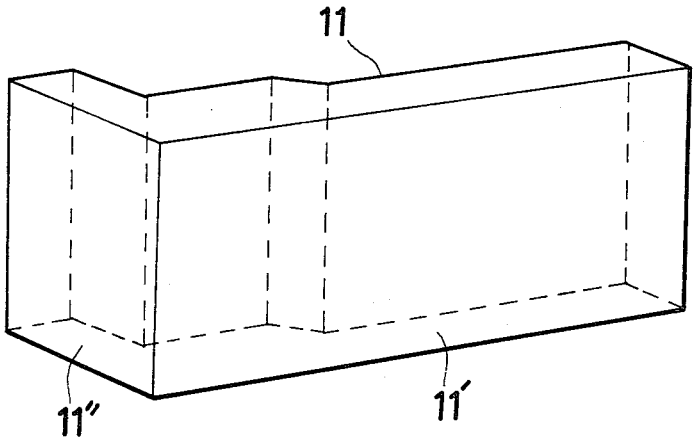
FIG. 5 is a perspective view of a second tile.

Reference numeral 11 (FIG. 5) denotes a second tile for use in the portion of the panel located at a corner of a tiled wall. The second tile has a substantially L-shaped configuration including a longer leg 11' and a shorter leg 11'' which is integral with and forms a right angle with the longer leg. The portion of the longer leg 11' furthest away from the shorter leg 11'' is reduced in thickness for the purpose to be described hereinafter.

Reference numeral 12 (FIG. 6) denotes a second holding member which is used with the second tile 11. The holding member 12 is an elongated strip made of aluminum which has a substantially U-shaped cross-section. The inner surface of the holding member 12 has a dovetailed recess 13 in the center portion thereof which extends along the length of the member 12. The opposite side edges of the aluminum strip are bent outwardly, as shown in FIG. 6, at right angles to the parts located between the upper and lower bent side edges and recess, thereby forming upper and lower engaging pieces 14 and 15 for engaging the reduced portion of the longer leg 11' of the second holding member for thereby holding the holding member in position.

The width of the first and second tiles 5 and 11 is selected so that when the tiles are set on the respectively associated holding members 6 and 11, respectively, joint spaces are provided between the adjacent tiles in both a vertical and horizontal direction.

When building a tiled wall on a desired part of a building, a plurality of panels a are attached to spaced pillars 16 and 17 in a vertical array with the first connections 2 positioned on the top and the second connections 3 positioned at the bottom, and the projections 4 and 4' disposed on the outer side and further, with connection 2 of one panel a engaging the recess formed in the reverse or inner surface in the lower part of the panel or specifically at projection 4' of the panel which is positioned just above the first panel. The second connection 3 of the second described panel is applied against the outer surface of the part of the particular panel which is positioned just below the first connection 2 of the second described panel.

Thereafter, the first holding member 6 is attached to on the associated projection 4 or 4' of the panel a by engaging the lower leg of the first engaging portion 6a with the undersurface of the lower leg of the projection and the flat portion 6c abuts against the portion of the panel which is positioned right below the associated projection 4 or 4'. A screw 18 is then forced through the flat portion 6c of the first holding member 6 and the portion of the panel which is positioned right below the associated projection and threaded into the piller 16 or 17 for securing the panel assembly thereon. The same procedure is repeated for the other panels and associated holding members.

Figure 8:
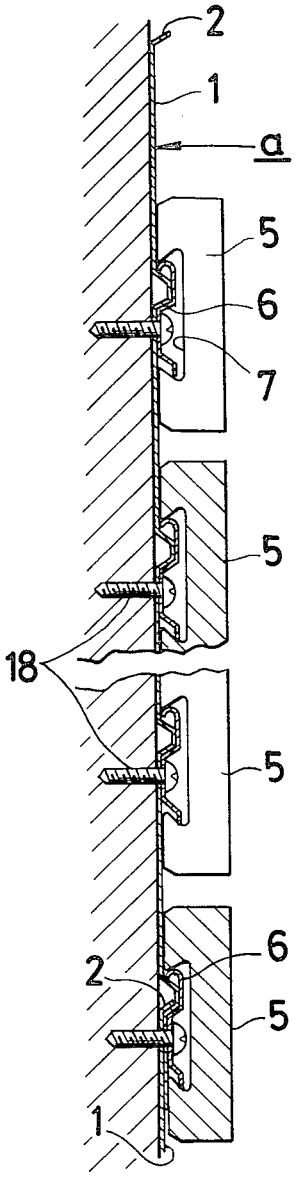
FIG. 8 is similar to FIG. 7, but shows the pillar as further having a plurality of the first tiles secured to the panel.

Thereafter, the tiles 5 are horizontally engaged by the individual holding members 6 at appropriate spacings for allowing joining spaces between each of two adjacent tiles. In setting the tiles 5, the lower wall face 10 of the dovetailed groove 7 in each of the tiles 5 engages the second engaging portion 6b of the associated holding member 6 and the upper wall face 9 of the dovetailed groove 7 is then interlocked with the first engaging portion 6a of the associated holding member 6 so that the file 5 is firmly attached to the holding member 6 with the first engaging portion 6a of the holding member 6 press-fitted on the upper wall face 9 of the tile 5 (FIGS. 8 and 10).

Figure 9:
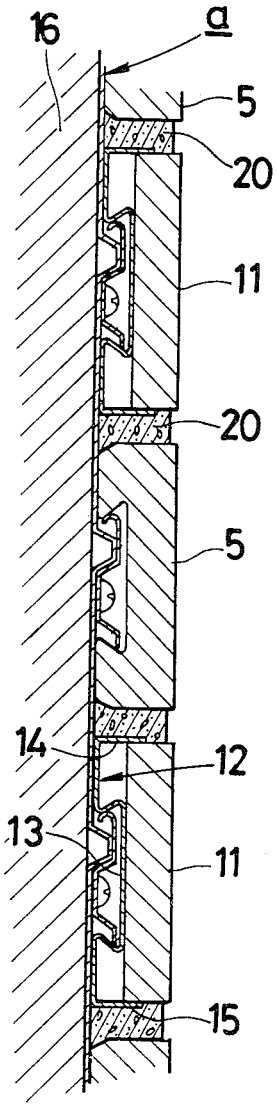
FIG. 9 is similar to FIG. 7, but shows the pillar as having a complete tiled wall formed thereon.

When forming a corner portion of the tiled wall (at the pillar 16 as seen in FIG. 10), a corner bead 19 having the same thickness as the base plate 1 of the panel a is attached to the outer corner of the pillar 16 where the corner tiles 11 are to be set. The second holding member 12 is fitted on the corner bead with the longer and shorter legs of the holding member closely adjacent to the corresponding legs of the corner bead, respectively so that the recess 13 in the holding member is fitted on the corner with the second tile 11 in substantially the same manner as described for thereby attaching the tile 5 to the holding member 6 (FIGS. 9 and 10).

The lateral spacing dimensions for the joints between the adjacent tiles 5 or 11 can be suitably and automatically spaced by setting the tiles 5 and 11 on the holding members 6 and 12, respectively, allowing equal spacing between the adjacent tiles which are secured to the projections 4 and 4', respectively.

After setting the tiles 5 and 11 on the holding members 6 and 12, respectively in the manner described hereinabove, mortar is filled in the joint spaces between the tiles for finishing the tiled wall.

In the described embodiment, since each of the panels a comprises an aluminum base plate 1, the complete tiled wall is free from disadvantages such as corrosion which occurs on small width metal plates and/or cracks in the underlying mortar layer on which the metal plates and mortar layer have been conventionally employed in the prior art tiled wall building methods.

In addition, although a description has been given in which the elongated tiles which have a greater dimension in the horizontal direction and a smaller dimension in the vertical direction are set on aluminum panels, the panels are not necessarily limited to aluminum plates, but may be made of synthetic resin sheets having the same integral vertically spaced and parallel tile position indexing projections formed thereon. Alternatively, the holding members may be directly secured to the panels having no projections formed thereon by means of adhesive, nails or other suitable securing means with appropriate joint spaces provided between the adjacent holding members. Furthermore, the shape of the tiles is not limited to the illustrated elongated one, but may be square, hexagonal or other polygonal shapes.

As is clear from the foregoing description of the preferred embodiment of the invention, since the tile holding members are secured to and along the projections which are located on the panel, the various components of the tiled wall are quite simple, suitable for mass production and less expensive than conventional materials. Since small width plates and underlying mortar layer which have been conventionally employed are not required in the device and method of the invention, the plate nailing and mortar placing steps are eliminated whereby tiled wall building by the device and method of present invention can be carried out simply and economically.

The indexing of the joint spacings between the tiles can be automatically and simply performed by merely placing the tiles on the holding members in suitably spaced relationship. Since the tiles are firmly held on the holding members, the tiles cannot be displaced inadvertently during the tiled wall building operation. The setting of the first tiles on the first holding member is simply performed by first engaging the lower side walls 10 of the dovetailed grooves 7 in the tiles 5 on the second engaging portions **6*b* on the associated holding members 6. The upper edges on the upper sides of the dovetailed grooves 7 are then forced to slide along the first engaging portions 6*a* on the holding members 6 until the upper side walls 9 of the grooves 7 snap onto the first engaging portions 6*a* on the holding members 6 until the upper side walls 9 of the grooves 7 snap onto the first engaging portions 6*a* of the holding members because of the inherent resiliency of the material of the holding members 6. This could be done by unskilled workers without requiring specific securing means such as adhesive. More particularly, the tile setting operation can be performed even by unskilled workers with a high degree of efficiency and at a lower cost of labor. The setting of the second tiles 11 on the second holding members 12 is apparent from the previous description of the construction of the wall with the components with reference to FIGS. 5 and 6** so the description of the second tile setting method will be omitted.

Furthermore, according to the present invention, since aluminum or synthetic resin panels are employed, the plates are free from disadvantages such as corrosion of conventionally used small width plates and/or cracks in the underlying mortar layer in which small width plates and an underlying mortar layer have necessarily employed in conventional tile setting methods.

While only one embodiment of the invention has been shown and described in detail, it will be understood that it is for illustration purposes only and not to be considered as limiting the invention in any way, the invention being set forth in the following claims.

What is claimed is:

1. A tile setting assembly for buildings having horizontally spaced pillars, comprising:

(a) at least one panel which spans at least two pillars of the building, said panel having a plurality of equally spaced and parallel position indexing projections extending the entire length of said panel horizontally along one surface thereof;

(b) first tiles having first mating engaging means;

(c) second tiles having second mating engaging means;

(d) first tile holding members secured to said panel, said first tile holding members abutting against said projections and each having first engaging means for holding said first tiles by first engaging means; and (e) second tile holding members secured to said panel, said second tile holding members abutting against said projections and each having second engaging means for holding said second tiles by second mating engaging means.

2. A tile setting assembly as set forth in claim 1 wherein:

(a) said first tile holding member engaging means for holding said tiles have a first engaging portion which extends along the upper side of said first tile holding members and has a substantially U-shaped cross-section, and a second engaging portion which extends along the lower side of said first tile holding member and has a substantially L-shaped cross-section, said second engaging portion being parallel to and spaced from said first engaging portion;

(b) said first mating engaging means is a dovetailed groove which is located in the longitudinal center of said first tiles and extends along the length of said first tiles for snapping engagment with said first and second engaging portions of said holding members, the width of the said groove being slightly smaller than the distance between said first and second engaging portions, between the outer edges of said groove and the width at the bottom of said groove being slightly greater than the distance between said first and second engaging portions;

(c) said second tile holding members engaging means for holding said second tiles have a first outwardly bent piece which extends along the upper side of said second tile holding member and is parallel to and spaced from said first piece; and (d) said second tiles have a substantially L-shaped configuration with one leg longer than the other, said longer leg having a reduced thickness portion, said second tiles being embraced by said first and second outwardly bent pieces, said L-shaped tiles being used to build the corners of tiled walls.

3. A tile setting assembly for buildings having pillars for setting tiles having a dovetailed groove located in the longitudinal center of said first rectangular tiles and extending along the length of said first rectangular tiles and for setting second L-shaped tiles having a shorter leg and a longer leg extending at right angle to said shorter leg and having a reduced thickness portion thereon, said setting assembly comprising:

(a) at least one panel which spans at least two pillars of the building, said panel having a plurality of equally spaced and parallel tile position indexing projections extending along the entire length of said panel on one surface thereof;

(b) first tile holding members secured to said panel, said first tile holding members abutting against said projections and each having first engaging means for holding said first rectangular tiles, said first engaging means having a first engaging portion which extends along the upper side of said first rectangular tile holding member and has a substantially U-shaped cross-section, and a second engaging portion which extends along the lower side of said first tile holding member and has a substantially L-shaped cross-section, said second engaging portion being parallel to and spaced from said first engaging portion, whereby said first rectangular tiles are held on said first rectangular holding members by engagement between said dovetailed groove and said engaging portions of said first engaging means; and (c) second L-shaped tile holding members secured to said panel, said second L-shaped tile holding members abutting against said projections and each having second engaging means for holding said second L-shaped tiles, said second engaging means having a first outwardly bent piece which extends along the upper side of said second L-shaped tile holding member and a similarly bent second piece which extends along the lower side of said second tile holding member and is parallel to and spaced from said first piece, whereby said second L-shaped tiles are embraced by said first and second outwardly bent pieces.

4. A tiled wall for buildings having pillars, comprising:

(a) a panel which spans at least two pillars of a building and has a plurality of equally spaced and parallel tile position indexing projections extending along the entire length of said panel on one surface thereof;

(b) a plurality of first rectangular holding members being secured to said panel in a position abutting said tile indexing projections, each of said rectangular holding members having spaced opposed engaging portions;

(c) a plurality of first tiles having engaging grooves in which said first rectangular holding members are engaged, said first tiles being set in horizontal and vertical arrays for defining joint spaces between each of said tiles.

(d) a plurality of second holding members secured along and adjacent to the horizontally extending ends of said panel, each of said second holding members having spaced opposed engaging pieces, a recess being defined between said spaced opposed engaging pieces, a recess being defined between said spaced opposed engaging pieces;

(e) a plurality of second L-shaped tiles set on said second holding members, said second L-shaped tiles having a shorter leg, for abutting against said pillars when set on said panel, and a longer leg integral with said shorter leg and extending at a right angle to said shorter leg, said L-shaped tiles being received in said recess and held therein by said engaging pieces, said L-shaped tiles, when set, being spaced fron each other and from said first tiles in an array for defining additional of said joint spaces; and (f) mortar placed within and filling said joint spaces.

5. A method for setting tiles comprising the steps of:

spanning at least two pillars of a building, with a panel, having tile indexing projections in vertically spaced rows extending along the entire length of one surface thereof;

securing a plurality of first holding members, each having engaging means, to said panel at said tile indexing projections, said first holding members secured to said panel throughout said panel except at the horizontal ends of said panel;

securing a plurality of second holding members, each having second engaging means, to said panel at said tile indexing projections along said horizontally extending ends of said panel;

securing first and second tiles respectively to said first and second holding members with joint spaces left between all of said tiles throughout said one surface of said panel; and filling said joint spaces between said first and second tiles with mortar.

6. A tile setting method comprising the steps of:

spanning at least two pillars of a building, with at least one panel, said panel being a base plate having tile indexing projections in vertically spaced rows extending along the entire length of one surface thereof;

securing a plurality of first holding members to said panel at said tile indexing projections, said first holding members secured to said panel throughout said panel except at the opposite horizontal ends of said panel, said first holding members having first and second engaging portions spaced from each other and parallel to each other;

securing a plurality of second holding members, each having first and second engaging pieces spaced from each other and parallel to each other, to said panel at said tile indexing positions at said horizontal ends of said panel;

setting first tiles on said panel, said first tiles having dovetailed grooves, which extend along the longitudinal center of said first tiles, snapping said first tiles onto said first holding members whereby said first and second engaging portions engage said groove while spacing said first tiles from each other for providing joint spaces between each of said first tiles;

setting second tiles on said panel, said second tiles, holding said second tiles thereon by engaging them with said second holding members, said second tiles having a reduced thickness portion whereby said second tiles are held on said panel by being embraced by said first and second engaging pieces of said second holding members, said second tiles further being spaced from each other whereby joint spaces are located between each of said second tiles and further between each of said first tiles; and filling said joint spaces with mortar.

7. A tile setting method as set forth in claim 6 wherein said dovetailed groove has a smaller width at the outer edge than at the bottom of said groove, further said width at said outer edge being smaller than the distance between said first and second engaging portions of said first tile holding members and said width at said bottom of said groove being greater than said distance between said first and second engaging portions whereby said first and second engaging portions are snappingly engaged in said dovetailed groove.

* * * * *